US008037857B2

(12) United States Patent
Sailer et al.

(10) Patent No.: US 8,037,857 B2
(45) Date of Patent: Oct. 18, 2011

(54) HYDRAULIC SUPPORT ELEMENT FOR A SWITCHABLE CAM FOLLOWER OF A VALVE DRIVE OF AN INTERNAL COMBUSTION ENGINE

(75) Inventors: Peter Sailer, Erlangen (DE); Werner Bretting, Herzogenaurach (DE); Norbert Geyer, Hoechstadt (DE)

(73) Assignee: Schaeffler KG, Herzogenaurach (DE)

( * ) Notice: Subject to any disclaimer, the term of this patent is extended or adjusted under 35 U.S.C. 154(b) by 140 days.

(21) Appl. No.: 12/539,897

(22) Filed: Aug. 12, 2009

(65) Prior Publication Data

US 2010/0037845 A1 Feb. 18, 2010

(30) Foreign Application Priority Data

Aug. 13, 2008 (DE) ..... 10 2008 038 792

(51) Int. Cl.
*F01L 1/14* (2006.01)

(52) U.S. Cl. ..... 123/90.48; 123/90.52; 123/90.55; 74/569

(58) Field of Classification Search ..... 123/90.48, 123/90.52, 90.55, 90.39, 90.44; 74/559, 74/567, 569
See application file for complete search history.

(56) References Cited

U.S. PATENT DOCUMENTS 7,146,951 B2 * 12/2006 Sailer et al. ..... 123/90.45

* cited by examiner

*Primary Examiner* — Ching Chang
(74) *Attorney, Agent, or Firm* — Lucas & Mercanti, LLP

(57) ABSTRACT

A hydraulic support element for a switchable cam follower of a valve drive of an internal combustion engine, which has a pot-like housing with a bore, a pressure piston formed in one piece with an external casing and head projecting over an edge of the housing and a high pressure space for a hydraulic medium. The high pressure space is supplied, via a non-return valve from a first reservoir space, which is fed via first passages in the housing and pressure piston. A second reservoir space is formed in the pressure piston axially above the first reservoir space and is filled by second passages in the housing and pressure piston. From the second reservoir space a hydraulic medium is conducted to the cam follower via an opening in the head. The reservoir spaces are separated by a ball around which the internal wall of the pressure piston is wrapped.

6 Claims, 1 Drawing Sheet

HYDRAULIC SUPPORT ELEMENT FOR A SWITCHABLE CAM FOLLOWER OF A VALVE DRIVE OF AN INTERNAL COMBUSTION ENGINE

This application claims the priority of DE 10 2008 038 792.4 filed Aug. 13, 2008, which is incorporated by reference herein.

FIELD OF THE INVENTION

The invention relates to a hydraulic support element for a switchable cam follower of a valve drive of an internal combustion engine, having a pot-like housing in whose bore a pressure piston is guided with its external casing, which projects with its head over an edge of the housing between whose base and a facing underside of the pressure piston a high pressure space for hydraulic medium is formed, which high pressure space can be supplied, via a nonreturn valve arranged on the underside, from a first reservoir space, located above said nonreturn valve, of the pressure piston, which first reservoir space can be fed via first passages, located one behind the other in the direction of flow, in the housing and pressure piston, wherein a second reservoir space is formed in the pressure piston axially above the first reservoir space as far as the head, from which second reservoir space the hydraulic medium can be conducted to the cam follower via an opening in the head, which second reservoir space can be filled via second passages, located one behind the other in the direction of flow, in the housing and pressure piston, which reservoir spaces are separated from one another by partition means extending on an internal wall of the pressure piston.

BACKGROUND OF THE INVENTION

A support element of the generic type can be found in DE 103 30 510 A1. A small cap which is in the shape of an inverted U is applied as a partition means for separating the reservoir spaces in the pressure piston. At the same time it is apparent that the pressure piston is formed in two parts, specifically composed of an upper part with the partition means and a lower part with the hydraulic play-equalizing element. It is disadvantageous here that owing to the formation of the pressure piston in two parts its passages have to be located in the upper part. As a consequence of this, the passages in the housing are also positioned axially relatively far at the top. In particular, the arrangement of the passage for the upper reservoir space axially far at the top leads, during the installation of the support element, to a relatively large amount of leakage occurring from the cylinder head bore. Furthermore, it is noted that the small cap as a partition means does not, under certain circumstances, bear in a sufficiently close fashion against an internal wall of the pressure piston, in which case there is additionally the risk of it becoming loose. Furthermore, this small cap which is not obtained as a standard article must, for example, be deep drawn from a metal blank, which has adverse effects on the mass production costs.

OBJECT OF THE INVENTION

The object of the invention is therefore to provide a support element of the above-mentioned type in which the indicated disadvantages are eliminated.

MEANS OF ACHIEVING THE OBJECT

According to the invention, this object is achieved in that the partition means is embodied as a ball around which the internal wall of the pressure piston is wrapped in a belt-like fashion on both sides of the great circle of said ball, which great circle extends orthogonally to the axial line of the support element, wherein the pressure piston is formed in one piece.

A support element is therefore provided in which the disadvantages cited at the beginning are eliminated. The ball as partition means is available as an extremely economical mass produced article, for example from the roller bearing industry, and does not have to be formed separately. Owing to the fact that the internal casing of the pressure piston is wrapped around it, it bears in an extremely well sealed and secure fashion, with the result that hydraulic medium does not undesirably escape from one reservoir space into the other, and said ball does not become loose.

At the same time, annular grooves for feeding hydraulic medium in the external casing of the housing ensure that the support element is installed in a respective bore of the cylinder head without rotational orientation, that is to say in other words, it is possible to dispense with antirotational means, such as needles, etc. which protrude from the external casing of the housing.

It is particularly economical in terms of fabrication technology, when the pressure piston (optionally also the housing) is provided by a fabrication process such as flow pressing. It is clear at this point that the respective ball as the partition means is introduced into the interior of the pressure piston and, for example, pressed or rolled-in there when the head of the pressure piston is still open.

According to a further expedient embodiment of the invention, it is conceivable and is provided that the ball is held in such a way that it can move slightly axially in the section of its wrapped around portions. As a result, possibly undesirably accumulated air in the lower reservoir space can be discharged into the upper reservoir space. Alternatively, a duct in the wrapped-around region of the ball can also lead from one reservoir space into the other.

Finally, it is proposed to provide a valve drive of an internal combustion engine with hydraulic support elements having the features of the main claim, in which hydraulic support elements for nonswitchable cam followers without balls, which are virtually structurally identical to the hydraulic support elements for the switchable cam followers with the exception of upper passages which are not formed (since they are not necessary), are simultaneously used. Such a valve drive can be formed relatively economically since it is possible to resort to largely standardized components.

If appropriate, the ball can also serve as partition means in further switchable valve drive elements such as switchable roller tappets, amongst others, for separating reservoir spaces.

BRIEF DESCRIPTION OF THE DRAWING

The invention is expediently explained in more detail with reference to the drawing, in which.

DETAILED DESCRIPTION OF THE DRAWING

Figure 1:
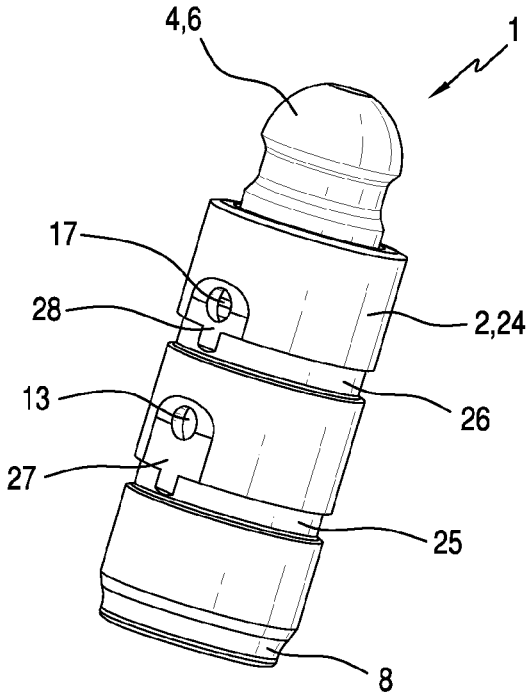
FIG. 1 shows a spatial view of a hydraulic support element.
Figure 2:
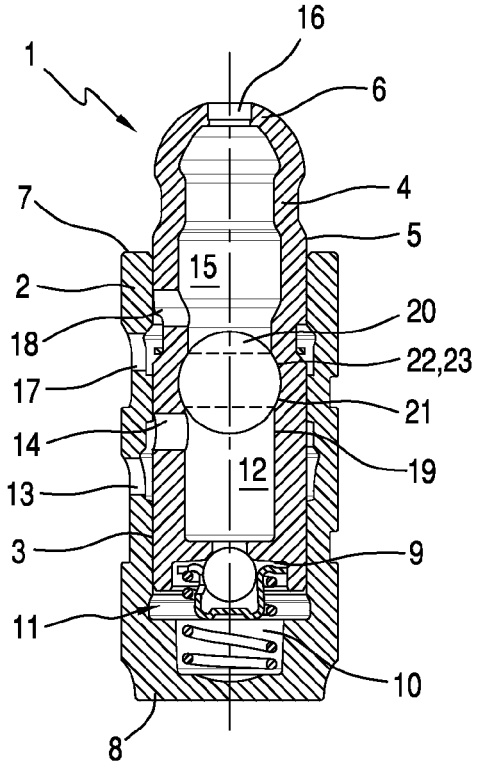
FIG. 2 shows the support element according to FIG. 1 in a longitudinal section.

FIGS. 1 and 2 disclose a hydraulic support element 1 for a switchable cam follower of an internal combustion engine. The support element 1 is composed of a pot-like housing 2, which can be installed in a bore of a cylinder head (not illustrated) by means of the external casing 24 of said housing 2.

In a bore 3 of the housing 2, an axially moveable pressure piston 4 is installed. Said pressure piston 4 projects with its head 6 over an edge 7 of the above-mentioned housing 2. An end of a switchable cam follower (not illustrated) can be supported in a pivotable fashion on the head 6. The head 6 has an opening 16 for hydraulic medium for the cam follower.

Between an underside 9 of the pressure piston 4 and a base 8 which closes the housing 2 at the cylinder head side, a high pressure space 10 for hydraulic medium is formed. Said high pressure space 10 can be supplied with hydraulic medium, via a nonreturn valve 11 attached to the underside 9, from a first reservoir space 12 located above said nonreturn valve 11. The pressure piston 4 is formed in one piece, which is favorable in terms of fabrication technology.

On an internal wall 19, approximately in the region of half its height, a ball extends as a partition means 20. The latter separates the first reservoir space 12 from a second reservoir space 15 located above it. The first reservoir space 12 serves, as a person skilled in the art will recognize without difficulty, only to supply the above-mentioned high pressure space 10.

From a first, lower annular groove 25, which has a fluidic connection to a first axial duct 27, the hydraulic medium is conducted into the first reservoir space 12 via a first passage 13 in the housing 2, an annular groove (not denoted) in the external casing 5 of the pressure piston 4 leading to a first passage 14 in the pressure piston 4. The passage 14 is located axially very close to the ball as a partition means 20. Air which has accumulated undesirably in the first reservoir space 12 can therefore be discharged almost completely from said reservoir space 12 in a radial direction outward via the first passages 14, 13.

From a second, upper annular groove 26, which has a fluidic connection to a second axial duct 27, hydraulic medium is conducted as "switching oil" into the second reservoir space 15 via a second passage 17 in the housing 2, an annular groove (not denoted) in the external casing 5 of the pressure piston 4 leading to a second passage 18 in the pressure piston 4. If a sufficiently high pressure is applied, the hydraulic medium then passes from the reservoir space 15 via the opening 16 in the head 6 to a switching device of the switchable cam follower bearing on it.

The ball as a partition means 20 separates the reservoir spaces 12, 15 from one another excellently. The wrapping around of the reservoir spaces 12, 15 by the internal wall 19 of the pressure piston 4, can be formed, for example, by a rolled-in portion 23 which is applied to the external casing 5 of the pressure piston 4. If appropriate, the ball can be pressed in or on or the like on one side or both sides as a partition means 20.

Figure 3:
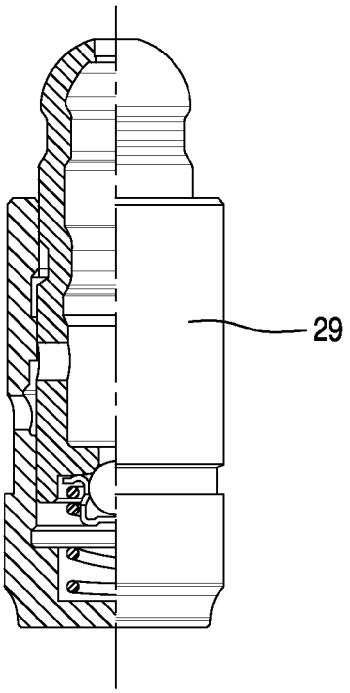
FIG. 3 shows a support element for a nonswitchable cam follower.

Since the above-mentioned annular grooves 25, 26 are formed in the external casing 24 of the housing 2, the support element 1 can be installed in the cylinder head without rotational orientation in its receiving bore. It is also to be noted that the upper passage 17 is located axially relatively far from the edge 7 of the housing 2, with the result that relatively small leakage losses of hydraulic medium are to be expected. FIG. 3 discloses a hydraulic support element 29. The latter is structurally identical to the previously described support element with the exception of the lack of a ball as a partition means 20 and the upper passages 17, 18 with an annular groove 26 and an axial duct 28. The support element 29 is intended to serve for supporting a nonswitchable cam follower at one end in the same valve drive.

LIST OF REFERENCE NUMERALS

1) support element
2) housing
3) bore in housing
4) pressure piston
5) external casing of pressure piston
6) head
7) edge
8) base
9) underside of pressure piston
10) high pressure space
11) nonreturn valve
12) first reservoir space
13) first passage in housing
14) first passage in pressure piston
15) second reservoir space
16) opening
17) second passage in housing
18) second passage in pressure piston
19) internal wall
20) partition means (ball)
21) lower wrapped around portion
22) upper wrapped around portion
23) rolled-in portion
24) external casing of housing
25) first annular groove
26) second annular groove
27) first axial duct
28) second axial duct
29) support element

The invention claimed is:

1. A hydraulic support element for a switchable cam follower of a valve drive of an internal combustion engine, comprising:

an elongated housing having an elongated blind bore therein, forming a base at one end of the housing and an opening at another end of the housing;

a pressure piston arranged in the bore of the housing and extending longitudinally from the opening of the housing, the piston having an underside at one end which opposes the base of the housing and a head at another end of the piston, which projects beyond the opening of the housing;

a first reservoir space in the pressure piston, located adjacent the underside of the piston;

a second reservoir space formed in the pressure piston axially above the first reservoir space and extending to the head of the pressure piston;

a high pressure space located between the base of the housing and the underside of the pressure piston;

a non-return valve arranged on the underside of the pressure piston providing fluid communication between the first reservoir and the high pressure space;

a first fluid passage in the housing extending from outside the housing into the bore;

a first fluid passage in the pressure piston, the first passage in the piston in fluid communication with the first passage in the housing and the first reservoir space in the piston;

a second passage in the housing extending from outside the housing into the bore;

a second passage in the pressure piston, the second passage in the piston in fluid communication with the second passage in the housing and the second reservoir space in the piston; and a ball partially surrounded and supported by an internal wall of the pressure piston and separating the first reservoir space from the second reservoir space.

2. The hydraulic support element of claim 1, wherein, the housing has a first external annular groove located axially underneath the first passage in the housing, a second external annular groove located axially underneath the second passage in the housing, a first axial duct, which leads from the first annular groove to the first passage in the housing and a second axial duct, which leads from the second annular groove to the second passage in the housing.

3. The hydraulic support element of claim 1, wherein the pressure piston is manufactured by flow pressing.

4. The hydraulic support element of claim 1, wherein an annular concave groove is formed in the internal wall of the pressure piston and the ball is bounded by the concave groove.

5. The hydraulic support element of claim 4, wherein the ball is axially moveable within the annular concave groove.

6. The hydraulic support element of claim 4, wherein the annular concave groove has a first longitudinal end and a second longitudinal end, the second longitudinal end is located adjacent the first passage in the pressure piston.

* * * * *